US008733264B2

(12) United States Patent
Krehbiel et al.

(10) Patent No.: US 8,733,264 B2
(45) Date of Patent: May 27, 2014

(54) METHOD AND APPARATUS FOR VARIABLE FLOATING STRUCTURES

(75) Inventors: Drew Linden Krehbiel, Richmond, TX (US); Richard D'Souza, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 0 days.

(21) Appl. No.: 11/673,297

(22) Filed: Feb. 9, 2007

(65) Prior Publication Data

US 2008/0190346 A1 Aug. 14, 2008

(51) Int. Cl.
*B63B 39/02* (2006.01)
*B63B 35/44* (2006.01)

(52) U.S. Cl.
USPC ..... 114/123; 114/267

(58) Field of Classification Search
USPC ..... 114/258–267, 121, 123, 124, 125
See application file for complete search history.

(56) References Cited

U.S. PATENT DOCUMENTS

| | | | | |
|---|---|---|---|---|
| 3,198,157 | A * | 8/1965 | Livas | 114/123 |
| 3,978,807 | A * | 9/1976 | Nitzki | 114/264 |
| 4,176,614 | A * | 12/1979 | Goss et al. | 114/125 |
| 4,622,912 | A * | 11/1986 | Bleke | 114/123 |
| 4,869,192 | A * | 9/1989 | Pawolski | 114/265 |
| 5,145,429 | A * | 9/1992 | Stoddart et al. | 441/4 |
| 6,378,451 | B1 * | 4/2002 | Wetch et al. | 114/265 |
| 6,503,023 | B2 | 1/2003 | Huang et al. | |
| 6,786,679 | B2 | 9/2004 | Huang et al. | |
| 6,899,492 | B1 | 5/2005 | Srinivasan | |
| 7,011,472 | B2 | 3/2006 | Martensson et al. | |
| 7,033,115 | B2 | 4/2006 | Huang et al. | |
| 7,140,317 | B2 | 11/2006 | Wybro et al. | |
| 7,506,606 | B2 * | 3/2009 | Murphy et al. | 114/368 |
| 7,673,577 | B2 * | 3/2010 | Poldervaart et al. | 114/230.1 |

FOREIGN PATENT DOCUMENTS

JP 56154385 A * 11/1981

* cited by examiner

*Primary Examiner* — Daniel V Venne
(74) *Attorney, Agent, or Firm* — Gary M. Machetta

(57) ABSTRACT

A method and apparatus for varying the buoyancy of a floating structure are provided. The method can include securing a plurality of floatation modules to at least a portion of the floating structure at various locations thereabout, while the floating structure is at sea such that the operational flexibility of the floating structure is modified.

22 Claims, 6 Drawing Sheets

METHOD AND APPARATUS FOR VARIABLE FLOATING STRUCTURES

CROSS REFERENCE TO RELATED APPLICATIONS

N/A

FIELD

The present embodiments relate generally to floating structures. More particularly, the present embodiments relate to methods and apparatus for modifying the buoyancy or weight handling capacity of floating structures.

BACKGROUND

In the production of offshore oil and gas, floating structures are used to support a platform for production and drilling operations. Floating structures use buoyant forces to keep the platform afloat. Cans (e.g. air cans) are common types of floating structures. Such cans are designed to support a certain weight associated with the platform structure, risers, and mooring lines, in addition to the production and support equipment located on the platform.

The weight of the platform to be supported varies depending on the depth of the water. At greater depths, longer risers and mooring lines, for example, are needed to reach between the sea floor and the platform, increasing the amount of weight to be supported in the water. The weight of the structure to be supported also increases with the weight of production and support equipment on the platform. Since the maximum weight bearing capacity of the overall platform is limited, moving a floating structure to deeper water depths or adding additional production or support equipment to the structure cannot be accomplished without increasing the buoyancy of the platform.

To increase the buoyancy of a platform, a new structure must be built or the existing structure can be towed back to shore and retrofitted to have increased buoyancy. The costs associated with a new structure and the costs associated with towing an existing structure back to shore for retrofit are significant. In addition, the lost production can be devastating to the economics of the well.

A need exists, therefore, for a solution to the limitations discussed above

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

Embodiments herein relate to apparatus and methods for modifying the buoyancy of an offshore platform. The apparatus and methods allow the buoyancy of an offshore platform to be modified at sea. Accordingly, the platform can be moved from one well to another and/or from one depth to another without lost production time associated with taking the platform out of service and towing the platform to land.

In at least one specific embodiment, the method includes securing one or more floatation modules to at least a portion of a floating structure at various locations thereabout, while the floating structure is at sea, such that the operational flexibility of the floating structure is modified without having to tow the floating structure back to shore. For example, a plurality or one or more floatation modules can be secured to a variety of platforms including tension leg platforms with no rig and no template, tension leg platforms with one rig and no template, tension leg platforms with multiple rigs and no template, tension leg platforms of various kinds including a template, semi-submersible platforms with no rig, semi-submersible platforms with one rig, semi-submersible platforms with multiple rigs, spar type platforms with no rig, spar type platforms with one rig, and spar type platforms with multiple rigs. A template is known in the art and is a sub-sea structure that holds one or more risers. Risers are pipes, known in the art, that bring fluid from sub-sea locations to the surface. The term "sea" includes all bodies of water.

Figure 1:
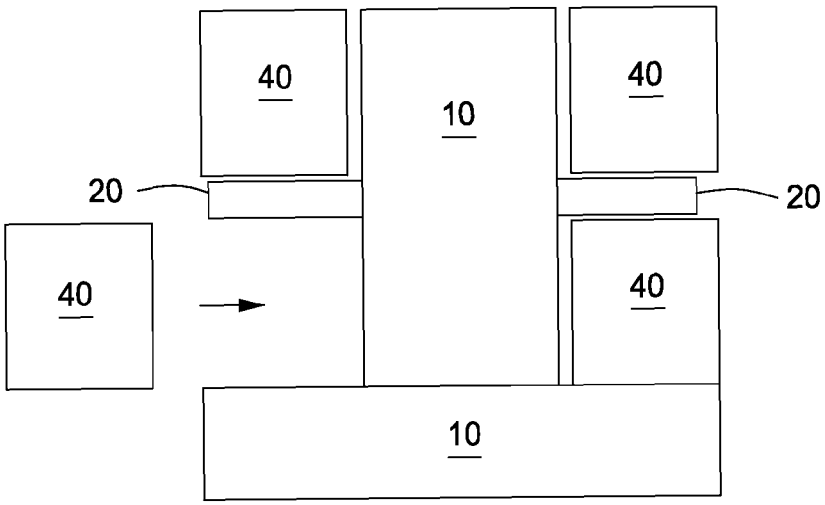
FIG. 1 depicts a schematic of a floating structure having one or more floatation modules according to one or more embodiments described.

With reference to the figure, FIG. 1 depicts a schematic of an offshore structure having one or more floatation modules according to one or more embodiments described. The offshore structure 10 can be of the floating type, submersible type, spar type, or tension leg type. In one or more embodiments, the buoyancy of the structure 10 can be modified or otherwise varied by adding or removing one or more floatation modules 40. Although four floatation modules 40 are shown, any number can be used. The modules 40 can be hollow containers with an inner volume that is at least partially filled with a fluid, such as air or water. The modules 40 can be added or removed in situ, i.e. at sea so that little or no production time is lost. As such, the buoyancy of the existing structure 10 can be modified at sea.

Each floatation module 40 can have any shape and size; the available shapes are not limited. Any floating shape could be used. For example, each module 40 can be cylindrical, tubular, square, rectangular, elliptical, toroidal or semi-hemispherical. In one or more embodiments, a homogenous type shape can be used so that the resulting floating attitude is predictable and manageable. In one or more embodiments, a non homogenous shape like a wedge or free shape can be used.

As mentioned, each floatation module 40 can be at least partially filled with a fluid to have certain buoyancy. In one or more embodiments, each module 40 can be filled with fluid to a different capacity thereby having different buoyancy than the others. In one or more embodiments, the buoyancy of the offshore structure 10 can be varied by varying the number of modules 40 or the amount of fluid contained therein.

In one or more embodiments, at least one floatation module 40 can be in fluid communication with at least one other module 40. As such, fluid can be transferred from one module 40 to any number of other modules 40 to vary the buoyancy of the offshore structure 10. In one or more embodiments, two floatation modules 40 can be in fluid communication with one another. In one or more embodiments, three floatation modules 40 can be in fluid communication with one another. In one or more embodiments, four floatation modules 40 can be in fluid communication with one another. In one or more embodiments, five floatation modules 40 can be in fluid communication with one another.

In one or more embodiments, the modules 40 can be installed to neutral buoyancy, so the modules 40 impart no weight on the platform. Therefore, any number of floatation modules 40 can be installed with out affecting the platform weight. The modules 40 can be linked to "communicate" with each other during final floating and or operational ballasting operations.

In one or more embodiments, the offshore structure 10 can further include one or more floatation rests 20 disposed thereon. The rests 20 can be an additional structural member disposed or otherwise attached to the structure 10, and can be permanently or removably secured to the structure 10. For example, the floatation rests 20 can be welded, latched, bolted, riveted, chained, strapped, roped, moored, or otherwise disposed on the offshore structure 10. Although not shown, two or more rests 20 can be disposed on the structure 10 such that each rest 20 supports a different surface of the floatation module 40. In one or more embodiments, two or more rests 20 can be combined to define a larger, single rest 20, also not shown.

In one or more embodiments, the floatation rests 20 can be buoyant. The location of the floatation rests 20 can be varied by floating, moving, and/or raising, as desired, the floatation rests 20 about the offshore structure 10. For example, the floatation rests 20 can be moved about the structure 10 in situ to accommodate weight changes on the structure 10. In one or more embodiments, additional rests 20 can be floated to a desired location for installation about the offshore structure 10. Similarly, rests 20 already installed on the offshore structure 10 can be moved or re-located in-situ, changing or modifying the buoyancy of the structure 10.

Each floatation module 40 can be disposed on at least a portion of any one or more of the floatation rests 20. Each floatation module 40 can be permanently or removably secured to any one or more floatation rest 20. In one or more embodiments, one floatation module 40 is disposed on a single floatation rest 20. In one or more embodiments, two or more floatation modules 40 are disposed on a single floatation rest 20.

In one or more embodiments, the floatation rests 20 can extend away from the structure 10 and configured to engage or otherwise secure to the floatation module 40. In one or more embodiments, the location of the floatation module 40 can be varied by floating, moving and/or raising, as desired, the floatation module 40 about the structure 10. In one or more embodiments, the floatation rests 20 can be permanently or removably secured to the floatation module 40 and the combination can be floated, moved and/or raised in situ, as desired, about the structure 10. For example, the floatation module 40 and/or the combination of the floatation modules 40 and floatation rests 20 can be floated, moved and/or raised in situ, as desired, to accommodate weight changes on the structure 10 to support and/or stabilize the structure 10. Such weight changes can be due to equipment changes or modifications above the deck or upper surface of the platform.

In one or more embodiments, the floatation rests 20 can be disposed on the structure 10 while the structure 10 is at sea. In one or more embodiments, the floatation rests 20 can be disposed on the structure 10 during shore-based assembly, upgrade, or repair operations. The floatation rests 20 can be any size and shape and can be disposed on any portion of the structure 10.

In one or more embodiments, the floatation rests 20 provide a partial structural interface between the structure 10 and floatation modules 40. For example, floatation modules 40 can be disposed on a portion of the floatation rests 20 which have been disposed on the structure 10 below or above the water line 67. In one or more alternative embodiments, the floatation rests 20 provide the only structural interface between structure 10 and floatation modules 40.

The buoyancy of an existing structure 10 may be modified for the operational flexibility of the structure 10. For example, the platform deck may need to be raised from the water to prevent storm waves from crashing over a top portion of the platform and capsizing the platform. In one or more embodiments, the buoyancy of a given platform may be increased so that the platform can be moved to deeper water and the increased weight associated therewith can be supported. At greater depths, longer risers and mooring lines, for example, are needed to reach between the sea floor and the platform, increasing the amount of weight to be supported in the water. In one or more embodiments, the buoyancy of a given platform may be increased to support more production components or more support equipment. In one or more embodiments, the buoyancy of a given structure 10 may be modified, while the structure 10 is at sea, to raise or lower the structure in the water, support the increased weight associated with deeper water, and/or support different production components or support equipment to modify the operational flexibility of the structure 10.

Figure 2:
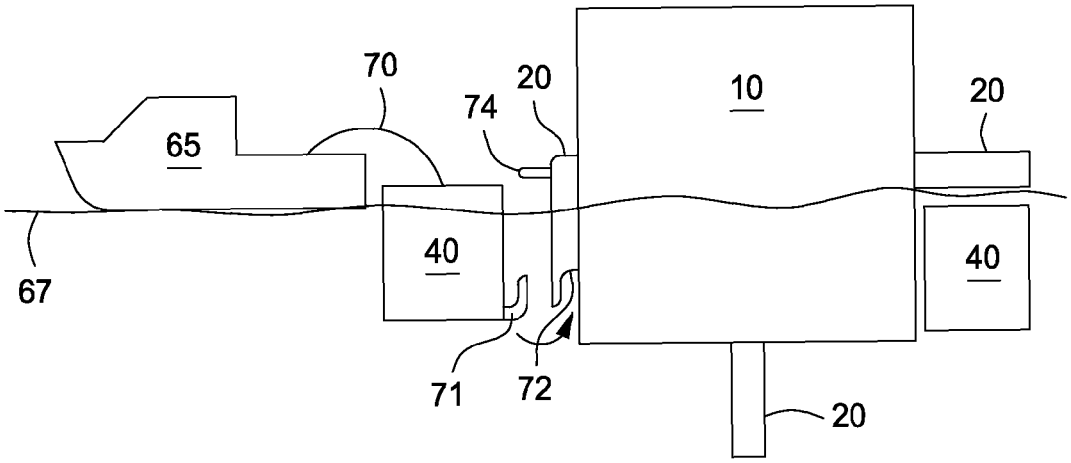
FIG. 2 depicts a partial schematic of an operation for varying the buoyancy of a floating structure according to one or more embodiments described.

FIG. 2 depicts a partial schematic of an operation for varying the buoyancy of a floating structure according to one or more embodiments described. A boat or vessel 65 can be used to transport or otherwise locate the one or more modules 40 (two are shown) to the offshore structure 10. The modules 40 can then be offloaded from the boat and placed in the water. The fluid within the modules 40 can then be varied, depending on the situation, to attach the modules 40 to various locations about the structure 10. For example, the modules 40 can be pre-filled with air to float above the water surface ("water line") 67 to attach to a higher location along the structure 10. The floatation modules 40 can be secured to the structure 10 above, partially above, below, and/or partially below the water line 67. In one or more embodiments, the floatation modules 40 can be at least partially filled with water to be at least partially submerged so that the modules 40 can be attached to a lower location along the structure 10. Once attached, the buoyancy of the floatation modules 40 can be varied to modify the buoyancy of the structure 10. For example, fluid can be added or evacuated from any one or more of the modules 40 to affect the buoyancy of the structure 10.

In one or more embodiments, the floatation modules 40 can be secured to the structure 10 by the opposing forces of the buoyant modules 40 and the weight of the structure 10 using one or more engaging members disposed or otherwise secured to the floatation modules 40 and the structure 10. For example, one or more engaging flanges 71 can be disposed on the one or more modules 40 and adapted to interface or otherwise engage one or more complementary engaging flanges 72 disposed on the structure 10. In one or more embodiments, an engaging flange 74 can be disposed on a rest 20 to support one surface of the floatation module 40 at a first end thereof while engaging flanges 71 and 72 support the floatation module 40 at a second end thereof. In one or more embodiments, the floatation rests 20 can be secured to the structure 10 above, partially above, below, and/or partially below the water line 67. The term "engaging flanges" as used herein, refers to any complementing structural support disposed on the one or more modules 40, rests 20 and/or structure 10 for engagement thereto.

Figure 3:
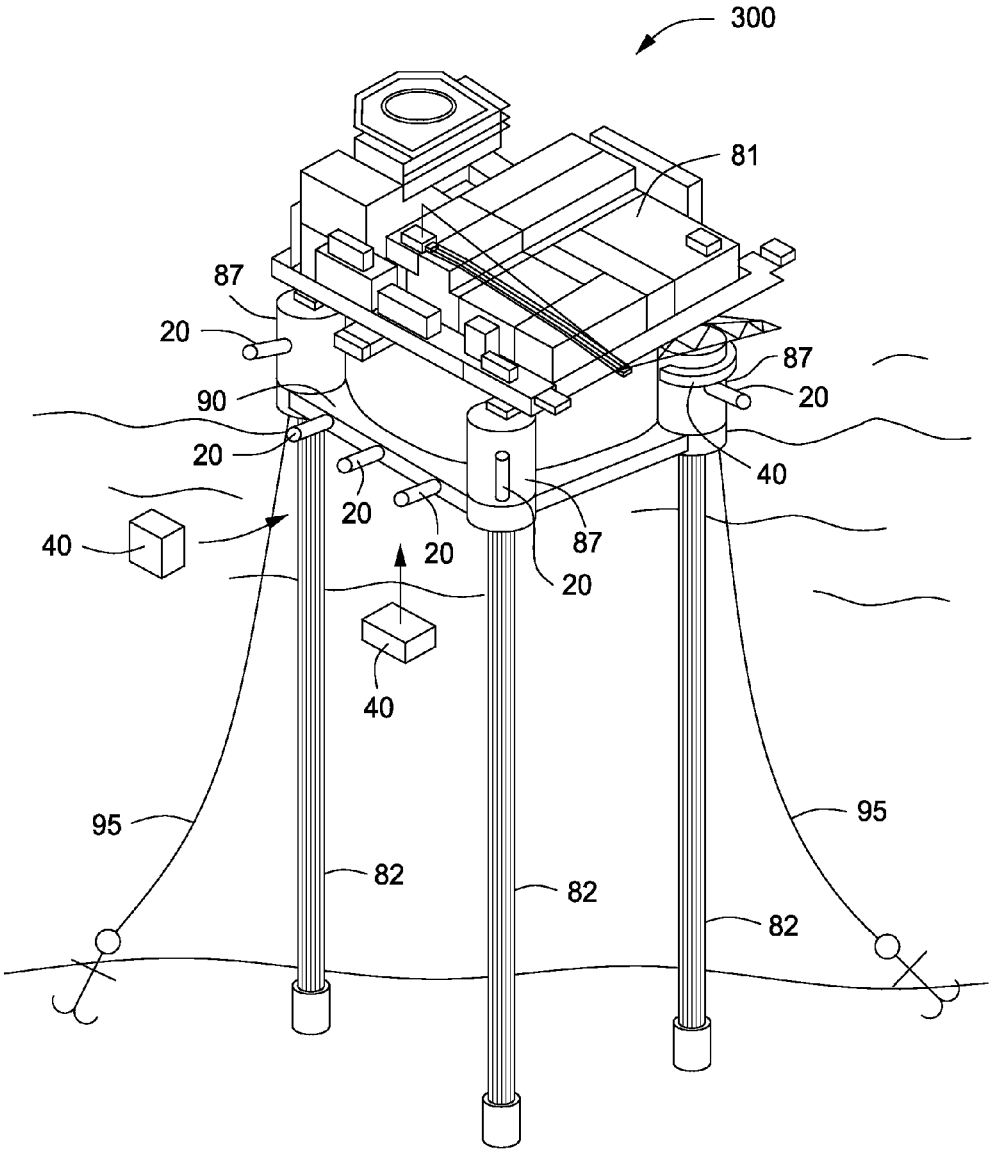
FIG. 3 depicts a partial schematic of an illustrative tension leg platform with no rig and no template according to one or more embodiments described.

FIG. 3 depicts a partial schematic of an illustrative tension leg platform with no rig and no template according to one or more embodiments described. The platform 300 can include a deck 81 supported on two or more cans 87. The cans 87 can be disposed about a support structure ("box") 90. One or more processing components and auxiliary equipment can be located on the upper surface of the deck 81. The platform 300 can be in fluid communication with a well (not shown) via one or more tension legs or risers 82. The risers 82 can be flexible risers such that the platform deck can be raised without affecting the risers 82. In one or more embodiments, the risers can be steel catinary risers (SCR).

To modify the buoyancy and thus the operational flexibility of the platform 81, one or more floatation modules 40 and/or one or more floatation rests 20 can be secured or otherwise disposed about the platform 300. For example, the one or more floatation modules 40 and/or one or more floatation rests 20 can be secured or otherwise disposed about the box 90, cans 87, and/or deck 81.

In one or more embodiments, the one or more floatation modules 40 and/or one or more floatation rests 20 can be secured or otherwise disposed about the risers 82. The cans and riser area can be designed for future expansions or, if space allowed, existing cans can be raised and attachments and floatation rests 20 added as needed.

The buoyancy of the floatation modules 40 and/or the buoyancy of the cans 87 can be varied to modify the buoyancy of the platform 300. In one or more embodiments, the buoyancy of the floatation modules 40 can be varied to supplement the buoyancy of the cans 87. In one or more embodiments, the buoyancy of the floatation modules 40 can be varied to modify the buoyancy of the platform 300 without changing the buoyancy of the cans 87.

In at least one specific embodiment, the floatation modules 40 are secured about the cans 87 to modify the buoyancy of the platform 300. The floatation modules 40 can be secured above, partially above, below, and/or partially below the cans 87. In one or more embodiments, at least one floatation module 40 is secured above the cans 87 and at least one floatation module 40 is secured below the cans 87. Although not shown, two or more floatation modules 40 can be secured to each other and disposed or otherwise attached to the platform 300.

As mentioned, the fluid within each floatation module 40 can be added or removed to vary the buoyancy thereof. In one or more embodiments, any number of floatation modules 40 can be added or removed from the platform 300. The floatation modules 40 can also be relocated to a different portion or side of the platform 300 as required to provide the necessary buoyancy or stability due to changes in the weather or production process.

Figure 4:
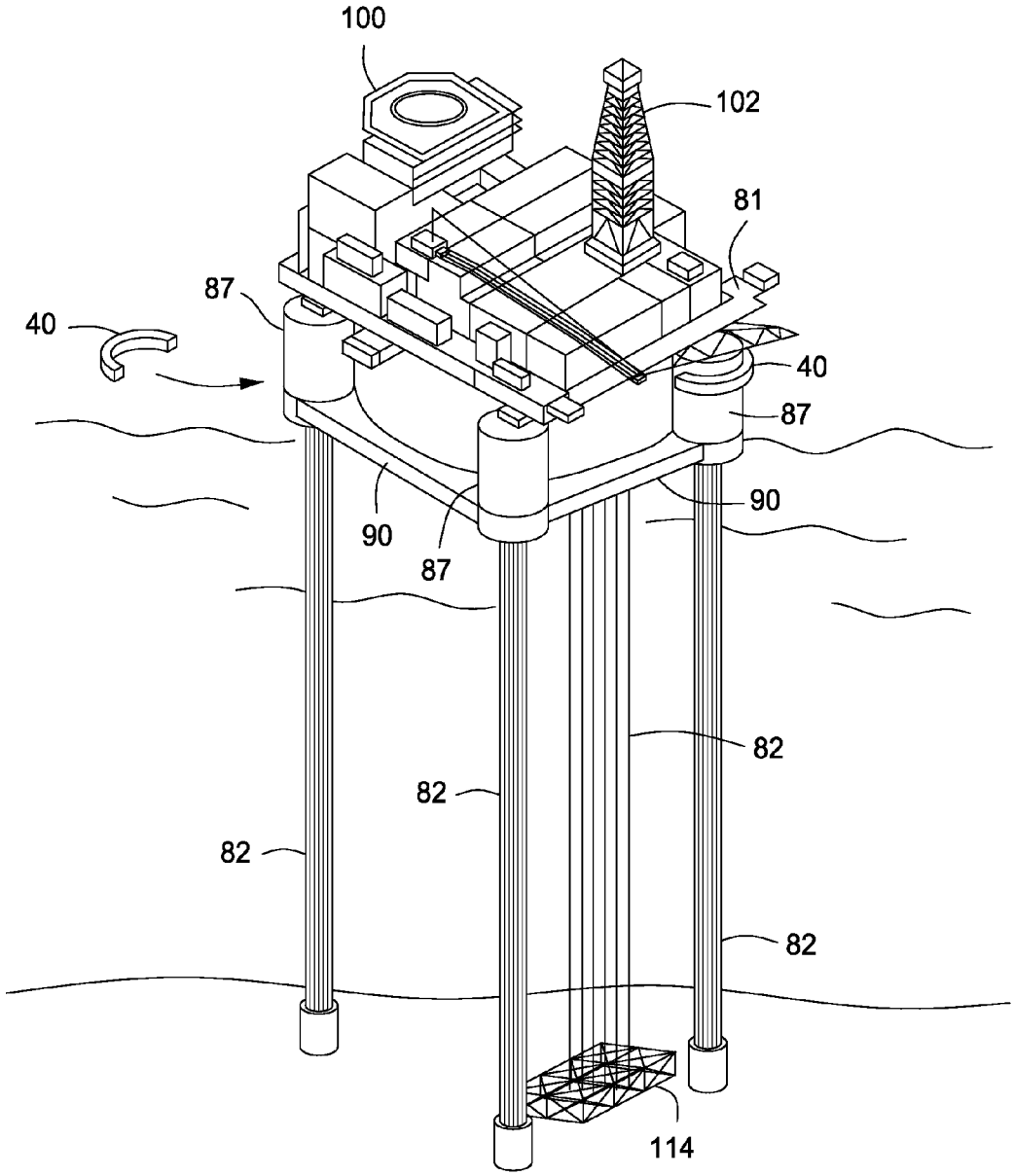
FIG. 4 depicts a partial schematic of an illustrative tension leg platform with one rig and a template according to one or more embodiments described.

FIG. 4 depicts a partial schematic of an illustrative tension leg platform with one rig and a template according to one or more embodiments described. As depicted, the tension leg platform 100 includes a rig 102 and template 114. One or more floatation modules 40 can be secured or otherwise disposed about any one or more components of the platform 100. As previously mentioned, the one or more floatation modules 40 can be secured or otherwise disposed about the steel box 90, cans 87, and/or deck 81.

In at least one specific embodiment, the floatation modules 40 are disposed or otherwise attached directly to the components of the platform 100. In other words, no rests 20 are used. For example, at least one floatation module 40 can be disposed or otherwise attached directly to the cans 87. In at least one other specific embodiment, at least one floatation module can be disposed or otherwise attached directly to a steel box 90. In at least one other specific embodiment, at least one floatation module can be disposed or otherwise attached directly below the cans 87 and/or the steel box 90.

Figure 5:
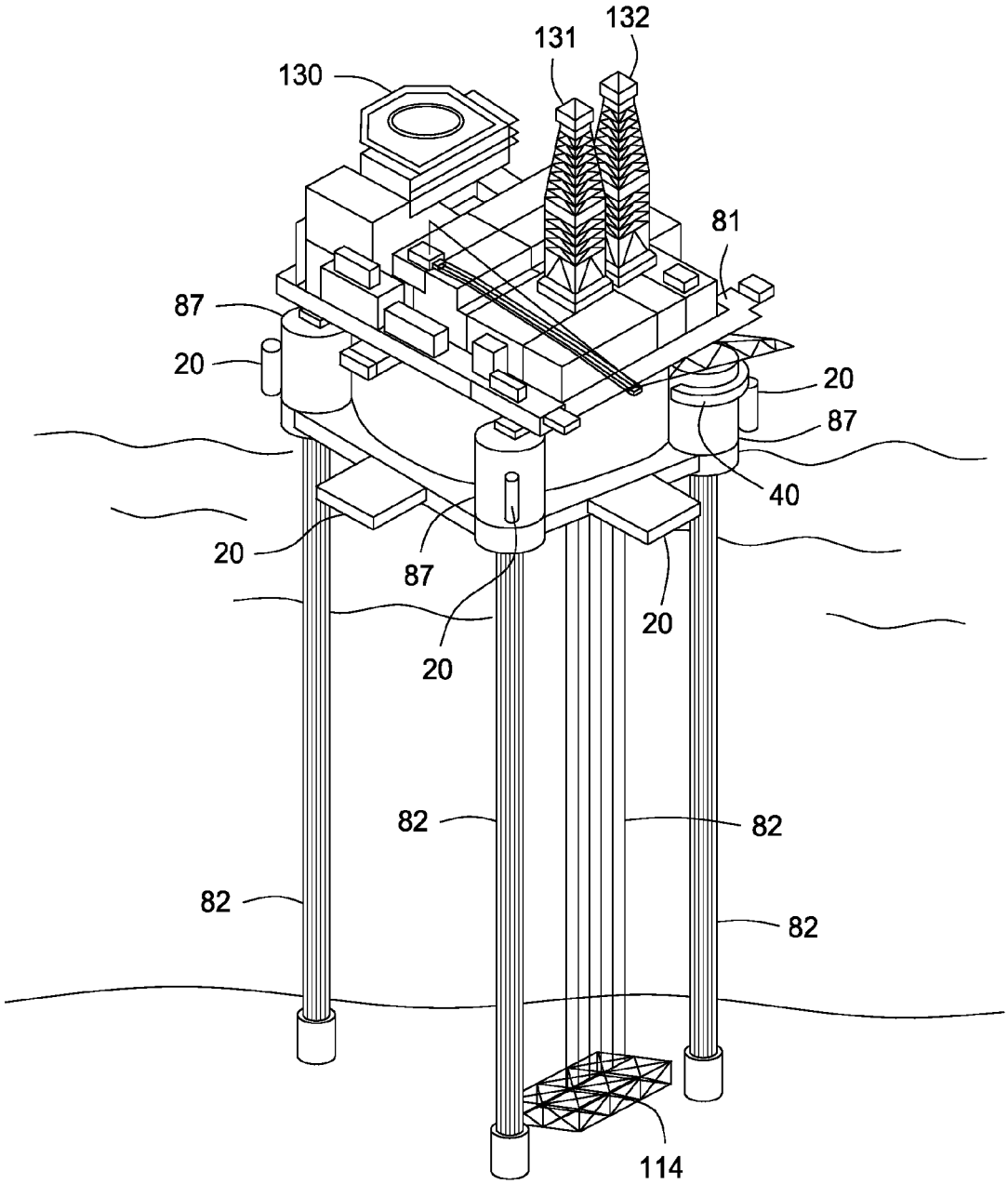
FIG. 5 depicts a partial schematic of an illustrative tension leg platform with multiple rigs and a template according to one or more embodiments described.

FIG. 5 depicts a partial schematic of an illustrative tension leg platform with multiple rigs and a template according to one or more embodiments described. As depicted, the tension leg platform 130 includes multiple rigs 131, 132 and a template 114. One or more floatation modules 40 can be secured or otherwise disposed about any one or more components of the platform 130. As previously mentioned, the one or more floatation modules 40 can be secured or otherwise disposed about the steel box 90, cans 87, and/or deck 81.

In at least one specific embodiment, one or more floatation modules 40 are disposed or otherwise attached directly to the components of the platform 100. In at least one other specific embodiment, one or more floatation modules 40 are disposed or otherwise attached to one or more rests 20 that are disposed or otherwise attached to the platform 130. For example, at least one floatation module 40 can be disposed or otherwise attached directly to the cans 87. In at least one other specific embodiment, at least one floatation module can be disposed or otherwise attached directly to a steel box 90. In at least one other specific embodiment, at least one floatation module can be disposed or otherwise attached directly below the cans 87 and/or the steel box 90.

Figure 6:
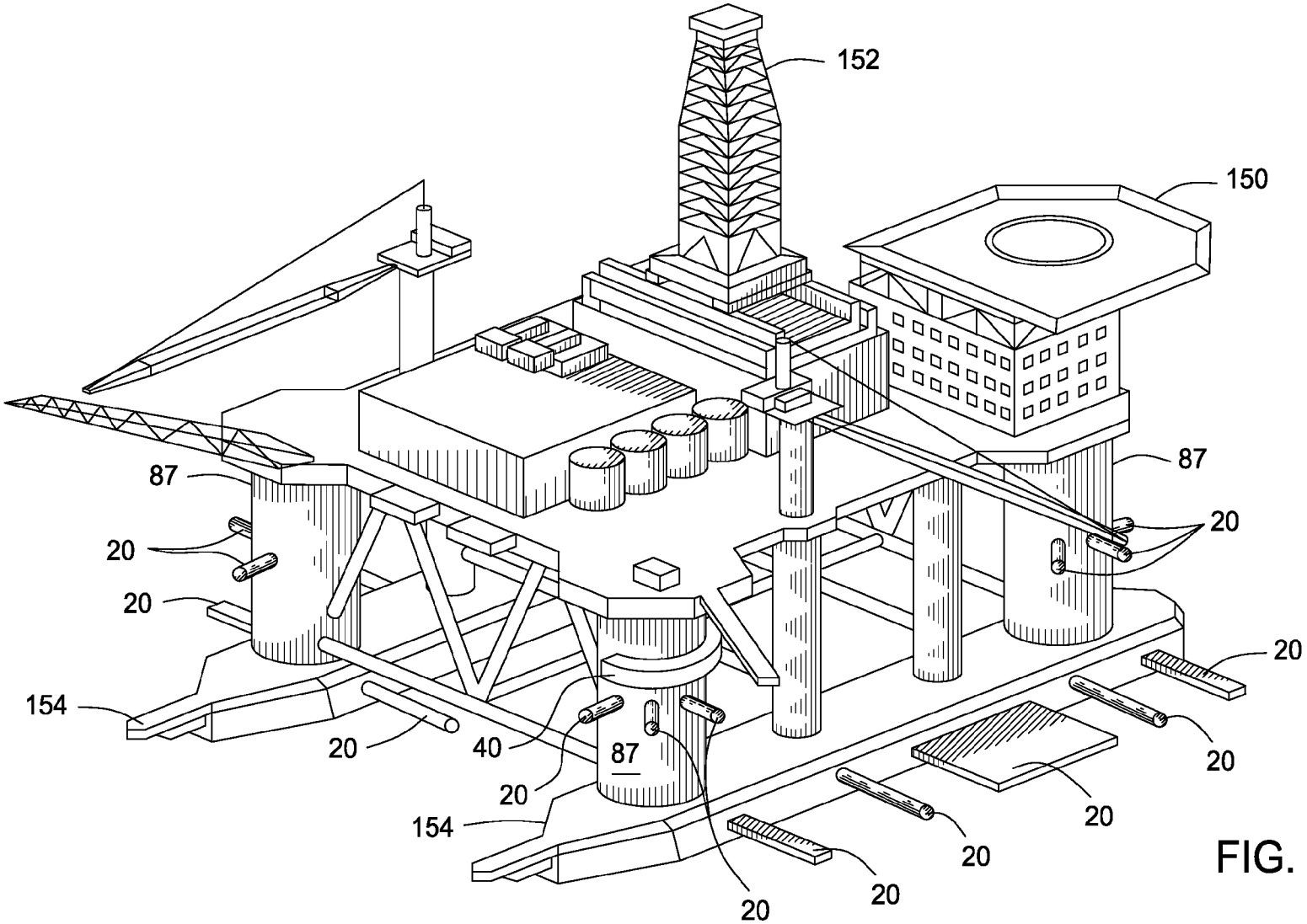
FIG. 6 depicts a partial schematic of an illustrative semi-submersible platform with one rig according to one or more embodiments described.

FIG. 6 depicts a partial schematic of an illustrative semi-submersible platform with one rig according to one or more embodiments described. As depicted, the semi-submersible platform 150 can include a rig 152, cans 87, and pontoons 154. In one or more embodiments, the one or more floatation modules 40 are attached to various locations along the cans 87 and/or the pontoons 154. One or more rests 20 can be used to facilitate the attachment of the modules 40.

The one or more floatation modules 40 can be secured to the semi-submersible platform 150 by varying the ballast in the pontoons 154 to partially sinking sink the platform 150. The floatation modules 40 can then be secured or disposed on the platform 150. The buoyancy of the floatation modules 40 can then be modified. For example, an air supply, not shown, can provide air to any one or more of the modules 40, or water can be added to or removed from any one or more of the modules 40. As such, the buoyancy of the platform 150 can be modified to take on more weight due to additional decking, risers, processing equipment, mooring, etc.

Figure 7:
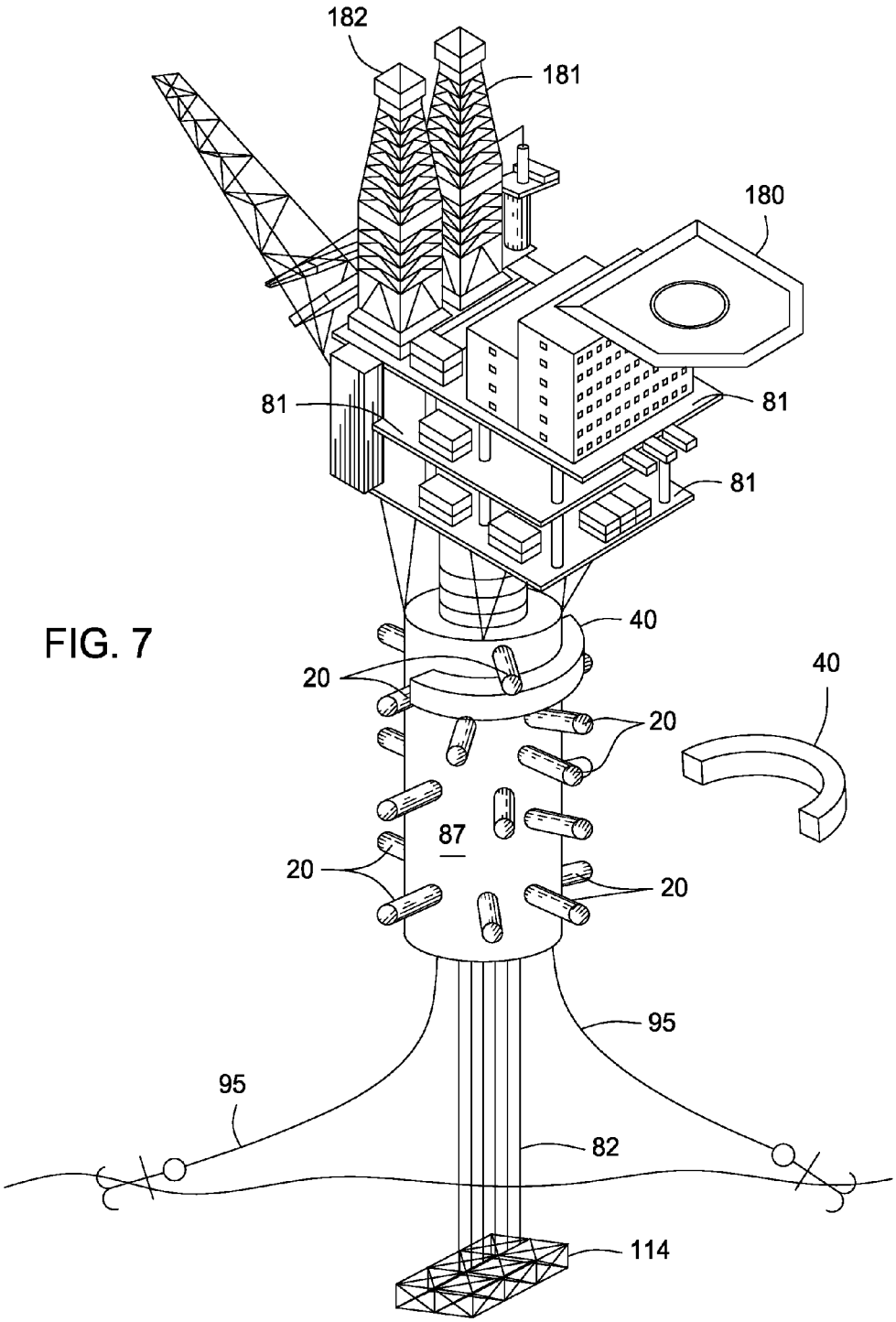
FIG. 7 depicts a partial schematic of an illustrative spar type platform with multiple rigs according to one or more embodiments described.

FIG. 7 depicts a partial schematic of an illustrative spar type platform with multiple rigs according to one or more embodiments described. As depicted, the spar type platform 180 can include one or more rigs 181, 182 supported on a centrally located can ("spar") 87. The can 87, although not shown, can be two or more cans 87 arranged in series or concentrically disposed cans 87. The spar type platform 180 can further include a template 114.

One or more floatation modules 40 can be secured or otherwise disposed about any one or more components of the platform 180. As previously mentioned, the one or more floatation modules 40 can be secured or otherwise disposed about the can 87 and/or deck 81.

In at least one specific embodiment, one or more floatation modules 40 are disposed or otherwise attached directly to the components of the platform 100. In at least one other specific embodiment, one or more floatation modules 40 are disposed or otherwise attached to one or more rests 20 that are disposed or otherwise attached to the platform 130. In yet another specific embodiment, the rests 20 can be located about the outer surface of the can 87. The rests 20 can be arranged uniformly or randomly about the can 87. In at least one other specific embodiment, at least one floatation module can be disposed or otherwise attached directly to a steel box 90. In at least one other specific embodiment, at least one floatation module can be disposed or otherwise attached directly below the cans 87 and/or the steel box 90.

In one or more embodiments, the floatation modules 40 are secured to the spar type platform 180 at various heights along the can 87.

Specific embodiments can further include methods for varying the buoyancy of floating structures, comprising securing a plurality of floatation modules to at least a portion of the floating structure at various locations thereabout, while the floating structure is at sea such that the operational flexibility of the floating structure is modified.

Specific embodiments can further include the methods discussed above or elsewhere herein and one or more of the following embodiments: wherein the floatation modules are secured along the floating structure at various locations to stabilize the structure in water; wherein the floatation modules are secured to the floating structure at equidistant points along the floating structure; wherein the floatation modules are secured to the floating structure at points below a water line of the floating structure; further comprising varying the buoyancy of the floatation modules such that the buoyancy of the floating structure is varied; wherein varying the buoyancy of the floatation modules is achieved by varying the amount of fluid present in an inner volume of the floatation modules; further comprising securing a plurality of floatation rests on a portion of the floating structure, and securing the plurality of floatation modules on a portion of the floatation rests, wherein securing the plurality of floatation modules on a portion of the floating structure comprises securing the floatation modules on a portion of the floatation rests; further comprising varying the locations of the floatation rests; wherein the floatation rests are buoyant; further comprising varying the buoyancy of the floatation rests such that the buoyancy of the floating structure is varied; and/or further comprising varying the locations of the floatation modules about the floating structure.

Specific embodiments can further include the methods discussed above or elsewhere herein and further comprising submerging the floatation modules by partially filling the modules with water, securing the modules to the floating structure, and evacuating a portion of the water from the floatation modules such that the buoyancy of the floatation modules is increased. Further, the methods in this paragraph can further include evacuating the majority of the water from the floatation modules.

Specific embodiments can further include platforms for offshore processing comprising a structure; one or more floatation modules, distributed about the structure at various locations, each having an engagement interface; and one or more floatation rests secured to the structure, wherein the floatation rests are buoyant, and wherein the engagement interfaces are secured to the floatation rest such that the modules are secured to the structure.

Specific embodiments can further include the platforms discussed above or elsewhere herein and one or more of the following embodiments: wherein the buoyancy of the floatation modules is variable and/or wherein the buoyancy of the floatation rests is variable.

Specific embodiments can further include methods for varying the buoyancy of a floating structure comprising: securing a floatation rest to a portion of the floating structure while the floating structure is at sea; submerging a plurality of floatation modules in the sea; and securing the floatation modules to a portion of the floating structure by securing the floatation modules to a portion of the floatation rests; wherein the floatation modules are secured along the floating structure at various locations to modify the operational flexibility of the structure and stabilize the structure in water.

Specific embodiments can further include the methods discussed above or elsewhere herein wherein the floatation rest is buoyant.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A method for operating a floating structure, comprising the steps of:

disposing a plurality of floatation rests on at least a portion of the floating structure, wherein the floatation rests are independently buoyant from the floating structure;

securing a plurality of floatation modules to at least a portion of the floatation rests after the floating structure is at sea such that the operational flexibility of the floating structure is modified, wherein the floating structure is partially submerged in the sea when securing the plurality of floatation modules to at least a portion of the floatation rests occurs, wherein at least one floatation module comprises a first engagement flange and at least one floatation rest comprises a second engagement flange, and wherein the first and second engagement flanges are complementary to one another and engage one another to secure the floatation module to the floatation rest; and varying the buoyancy of any one of the secured floatation modules such that the buoyancy of the floating structure is varied.

2. The method of claim 1, further comprising varying a location of at least one of the plurality of floatation modules after the floating structure is at sea and while the floating structure is partially submerged in the sea, wherein varying the location of the floatation module comprises disengaging the floatation module completely from the one or more floatation rests the floatation module is secured to prior to varying the location thereof.

3. The method of claim 1, further comprising varying the buoyancy of the floating structure by varying the number of floatation modules secured to the floatation rests while the floating structure is partially submerged in the sea.

4. The method of claim 2, wherein the floatation modules are secured to the floating structure at points below a water line of the floating structure.

5. The method of claim 1, further comprising varying the location of at least one of the floatation rests after the floating structure is at sea, wherein the floatation rest is at least partially submerged in the sea when varying the location thereof occurs.

6. The method of claim 1, further comprising varying the buoyancy of the floatation rests such that the buoyancy of the floating structure is varied.

7. The method of claim 1, wherein at least one of the plurality of floatation modules is completely submerged in the sea when securing the plurality of floatation modules to the floatation rests occurs, wherein the completely submerged floatation module is at least partially filled with water when secured to at least a portion of the floatation rests, the method further comprising evacuating a portion of the water from the completely submerged floatation module after the completely submerge floatation module is secured to at least a portion of the floatation rests such that the buoyancy of the one or more floatation modules is increased.

8. The method of claim 7, further comprising evacuating a majority of the water from the completely submerged floatation module after the completely submerged floatation module is secured to at least a portion of the floatation rests.

9. The method of claim 1, wherein the structure is a tension leg platform, a semi-submersible platform, or a spar type platform.

10. The method of claim wherein varying the buoyancy of the floatation modules comprises transferring fluid between two or more floatation modules.

11. A method for operating a floating structure, comprising the steps of:

disposing a plurality of floatation rests on at least a portion of the floating structure, wherein the floatation rests are independently buoyant from the floating structure;

securing a plurality of floatation modules to at least a portion of the floatation rests after the floating structure is at sea such that the operational flexibility of the floating structure is modified, wherein the floating structure is partially submerged in the sea when securing the plurality of floatation modules to at least a portion of the floatation rests occurs, wherein at least one of the plurality of floatation modules is secured to the floating structure by two or more floatation rests, and wherein each floatation rest supports a different surface of the floatation module; and varying the buoyancy of any one of the secured floatation modules such that the buoyancy of the floating structure is varied.

12. The method of claim 11, wherein at least one floatation module is secured to the floating structure at a point below a water line of the floating structure.

13. The method of claim 11, wherein at least one floatation module comprises a first engagement flange and at least one floatation rest comprises a second engagement flange, and wherein the first and second engagement flanges are complementary to one another and engage one another to secure the floatation module to the floatation rest.

14. The method of claim 11, wherein at least one of the plurality of floatation modules is completely submerged in the sea when securing the plurality of floatation modules to the floatation rests occurs, wherein the completely submerged floatation module is at least partially filled with water when secured to at least a portion of the floatation rests; and evacuating a portion of the water from the completely submerged floatation module after the completely submerge floatation module is secured to at least a portion of the floatation rests such that the buoyancy of the one or more floatation modules is increased.

15. A method for operating a floating structure comprising the steps of:

securing a plurality of floatation rests on at least a portion of the floating structure after the floating structure is at sea, wherein the floating structure is partially submerged in the sea when securing the plurality of floatation rests to at least a portion of the floating structure occurs, wherein the floating structure supports at least one riser for conveying fluid from a sub-sea location to the floating structure, and wherein the floatation rests are independently buoyant from the floating structure;

submerging a plurality of floatation modules in the sea; and securing the floatation modules to at least a portion of the floatation rests, wherein the floatation modules are secured about the floating structure at various locations to modify the operational flexibility of the structure and stabilize the structure in water, and wherein the floating structure is partially submerged in the sea when securing the plurality of floatation modules to at least a portion of the floatation rests occurs.

16. The method of claim 15, wherein at least one floatation module comprises a first engagement flange and at least one floatation rest comprises a second engagement flange, and wherein the first and second engagement flanges are complementary to one another and engage one another to secure the floatation module to the floatation rest.

17. A method for operating a floating structure, comprising the steps of:

securing a plurality of floatation modules on at least a portion of the floating structure after the floating structure is at sea such that the operational flexibility of the floating structure is modified, wherein the floating structure is partially submerged in the sea when securing the plurality of floatation modules to at least a portion of the floating structure occurs, wherein at least one of the plurality of floatation modules is secured to the floating structure by two or more floatation rests, and wherein each floatation rest supports a different surface of the floatation module; and transferring a fluid from at least one floatation module to at least one other floatation module.

18. The method of claim 17, wherein at least one floatation module comprises a first engagement flange and at least one floatation rest comprises a second engagement flange, and wherein the first and second engagement flanges are complementary to one another and engage one another to secure the floatation module to the floatation rest.

19. The method of claim 17, further comprising:

at least partially submerging the floatation modules by partially filling the modules with a fluid prior to securing the floatation modules on the floating structure such that the floatation modules are at least partially submerged in the sea when securing the floatation modules to the floating structure occurs; and evacuating a portion of the fluid from the floatation modules after securing the floatation modules on the floating structure such that the buoyancy of the floatation modules is increased.

20. The method of claim 17, further comprising disposing a plurality of floatation rests on the floating structure, wherein the floatation modules are disposed on at least a portion of the floatation rests, and wherein the floating structure is partially submerged when the floatation rests are disposed thereon.

21. The method of claim 17, wherein at least one of the floatation modules is completely submerged in the sea when securing a plurality of floatation modules on at least a portion of the floating structure occurs.

22. A method for operating a floating structure, comprising the steps of:

securing a plurality of removable floatation rests that are independently buoyant from the floating structure on at least a portion of the floating structure after the floating structure is at sea, wherein the floating structure is partially submerged in the sea when securing the floatation rests to the floating structure occurs;

securing a plurality of removable floatation modules to at least a portion of the removable floatation rests after the floating structure is at sea, wherein the floating structure is partially submerged in the sea when securing the floatation modules to the floating structure occurs;

detaching at least one of the secured floatation modules after the floating structure is at sea, wherein the floating structure remains partially submerged in the sea when the secured floatation module is detached therefrom;

relocating the detached floatation module to a different location about the floating structure after the floating structure is at sea, wherein the floating structure remains partially submerged in the sea while the detached floatation module is relocated;

securing the relocated floatation module to the floating structure or to one or more of the floatation rests after the floating structure is at sea, wherein the floating structure remains partially submerged in the sea while the relocated floatation module is secured to the floating structure or to one or more of the floatation rests; and varying the buoyancy of any of the plurality of floatation modules such that the buoyancy of the floating structure is varied.

* * * * *